US010253398B2

(12) United States Patent
Takaoka et al.

(10) Patent No.: US 10,253,398 B2
(45) Date of Patent: Apr. 9, 2019

(54) HIGH-STRENGTH STEEL FOR STEEL FORGINGS, AND STEEL FORGING

(71) Applicant: Kobe Steel, Ltd., Kobe-shi (JP)

(72) Inventors: Hiroyuki Takaoka, Takasago (JP); Tomonori Ikegami, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 170 days.

(21) Appl. No.: 15/102,482

(22) PCT Filed: Nov. 7, 2014

(86) PCT No.: PCT/JP2014/079629
§ 371 (c)(1),
(2) Date: Jun. 7, 2016

(87) PCT Pub. No.: WO2015/093179
PCT Pub. Date: Jun. 25, 2015

(65) Prior Publication Data

US 2017/0268083 A1 Sep. 21, 2017

(30) Foreign Application Priority Data

Dec. 19, 2013 (JP) ..... 2013-262720

(51) Int. Cl.
*C22C 38/44* (2006.01)
*C22C 38/46* (2006.01)
(Continued)

(52) U.S. Cl.
CPC ..... *C22C 38/54* (2013.01); *B21K 23/00* (2013.01); *C21D 1/18* (2013.01); *C21D 6/004* (2013.01);
(Continued)

(58) Field of Classification Search
None
See application file for complete search history.

(56) References Cited

U.S. PATENT DOCUMENTS

2010/0081004 A1 4/2010 Abiko et al.
2012/0060979 A1 3/2012 Kozawa et al.
2013/0340895 A1 12/2013 Kozawa et al.

FOREIGN PATENT DOCUMENTS

CN 101713489 A 5/2010
CN 102605272 A 7/2012
(Continued)

OTHER PUBLICATIONS

International Preliminary Report on Patentability and Written Opinion dated Jun. 30, 2016 in PCT/JP2014/079629 filed Nov. 7, 2014 (submitting English translation Only).
(Continued)

*Primary Examiner* — Deborah Yee
(74) *Attorney, Agent, or Firm* — Oblon, McClelland, Maier & Neustadt, L.L.P.

(57) ABSTRACT

The high-strength steel for steel forgings according to the present invention has a composition that includes, as basic components, C: 0.35 mass % to 0.47 mass %; Si: 0 mass % to 0.4 mass %; Mn: 0.6 mass % to 1.5 mass %; Ni: more than 0 mass % up to 2.0 mass %; Cr: 0.8 mass % to 2.5 mass %; Mo: 0.10 mass % to 0.7 mass %; V: 0.035 mass % to 0.20 mass %; Al: 0.015 mass % to 0.050 mass %; N: 30 ppm to 100 ppm, and O: more than 0 ppm up to 30 ppm, the balance being Fe and inevitable impurities. The metal structure is mainly bainite, martensite or a mixed structure of bainite and martensite. Among cubic B1-type precipitates, the number of coherent precipitates having a diameter equal to or smaller than 30 nm is equal to or smaller than 50/μm$^2$.

6 Claims, 1 Drawing Sheet

(51) Int. Cl.

| | |
|---|---|
| ***C22C 38/42*** | (2006.01) |
| ***C22C 38/48*** | (2006.01) |
| ***C22C 38/54*** | (2006.01) |
| ***C22C 38/00*** | (2006.01) |
| ***C21D 6/00*** | (2006.01) |
| ***C21D 8/10*** | (2006.01) |
| ***C22C 38/02*** | (2006.01) |
| ***C22C 38/04*** | (2006.01) |
| ***C22C 38/06*** | (2006.01) |
| ***B21K 23/00*** | (2006.01) |
| ***C21D 1/18*** | (2006.01) |
| ***C21D 9/00*** | (2006.01) |
| *C21D 8/00* | (2006.01) |
| *C21D 9/30* | (2006.01) |
| *C21D 7/13* | (2006.01) |

(52) U.S. Cl.

CPC ..... *C21D 8/105* (2013.01); *C21D 9/0068* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C21D 7/13* (2013.01); *C21D 8/00* (2013.01); *C21D 9/30* (2013.01); *C21D 2211/002* (2013.01); *C21D 2211/003* (2013.01); *C21D 2211/004* (2013.01); *C21D 2211/008* (2013.01)

(56) References Cited

FOREIGN PATENT DOCUMENTS

| | | | |
|---|---|---|---|
| EP | 1 602 742 | A1 | 12/2005 |
| EP | 2 671 963 | A1 | 12/2013 |
| JP | 3663170 | B2 | 6/2005 |
| JP | 3896365 | B2 | 3/2007 |
| JP | 2008-111146 | A | 5/2008 |
| JP | 2009-173861 | A | 8/2009 |
| JP | 4332070 | B2 | 9/2009 |
| JP | 2010-285689 | A | 12/2010 |
| KR | 10-2010-0036973 | A | 4/2010 |

OTHER PUBLICATIONS

International Search Report dated Feb. 10, 2015 in PCT/JP14/079629 Filed Nov. 7, 2014.

Extended European Search Report dated May 19, 2017 in European Patent Application No. 14872514.6.

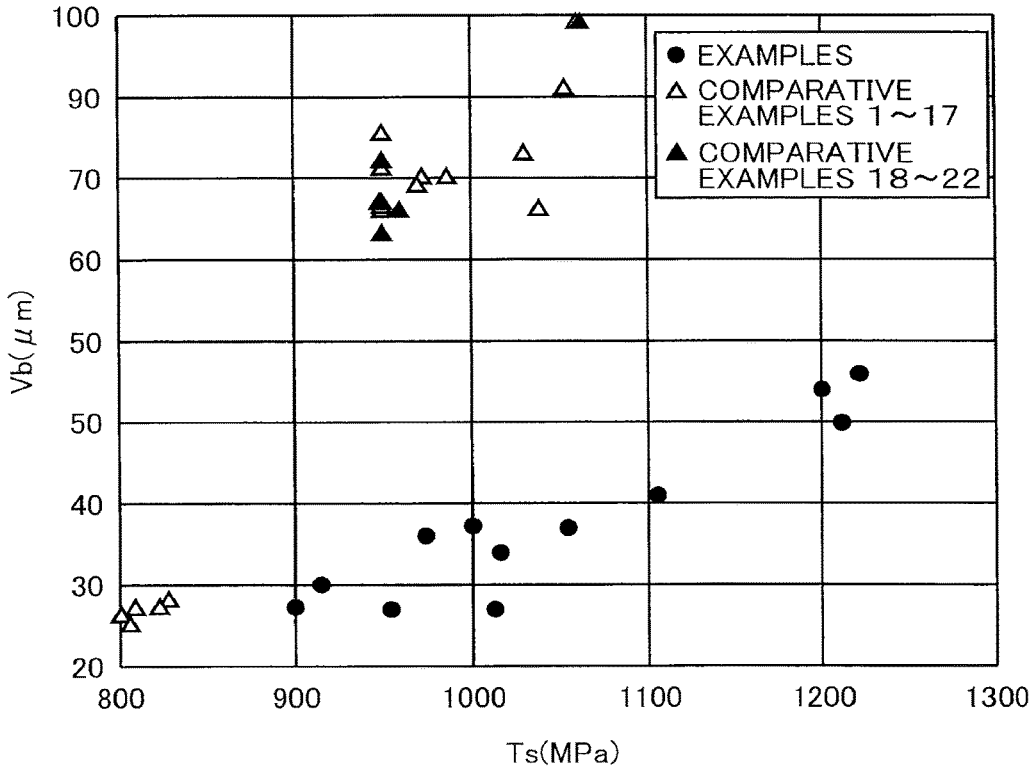
100
90
70
60
50
50
40
30
20
Vb(μm)
800
900
1000
1100
1200
1300
Ts(MPa)
EXAMPLES
COMPARATIVE EXAMPLES 1～17
COMPARATIVE EXAMPLES 18～22

HIGH-STRENGTH STEEL FOR STEEL FORGINGS, AND STEEL FORGING

TECHNICAL FIELD

The present invention relates to a high-strength steel for steel forgings and to a steel forging.

BACKGROUND ART

High fatigue strength, combined with high tensile strength of 850 MPa or higher, is required in steel materials that are used in parts of marine diesel engines and diesel engines for power generation, in order to achieve higher engine outputs and make the engines more compact.

Herein, NiCrMo high-strength steel has been developed as steel for large steel forgings having such high tensile strength (see for instance Japanese Patent No. 3896365 and Japanese Patent No. 4332070). These steel grades exhibit high strength and high toughness.

The steel that is used in large crankshafts that are utilized for drive power transmission in vessels or the like is subjected, after forging and a thermal treatment, to machining for the purpose of finishing to a final shape. In this case, both high machinability and high polishability (ease of finishing) during machining are simultaneously required.

Forging steels for large crankshafts, however, have high strength, i.e. a tensile strength of 850 MPa or higher, and exhibit substantial cutting resistance. Accordingly, finishing to the final shape through machining is time-consuming, which detracts from productivity. It has been ordinarily very difficult to combine tensile strength of 850 MPa or higher with both excellent machinability and polishability, since cutting resistance increases proportionally to the strength (hardness) of the material.

It is an object of the present invention, arrived at in the light of the above issues, to provide a high-strength steel for steel forgings, and a steel forging, having high strength and boasting excellent machinability and polishability.

CITATION LIST

Patent Literature

Patent Literature 1: Japanese Patent No. 3896365
Patent Literature 2: Japanese Patent No. 4332070

SUMMARY OF INVENTION

One aspect of the present invention is a high-strength steel for steel forgings having a composition that includes, as basic components, C (carbon): 0.35 mass % to 0.47 mass %, Si (silicon): 0 mass % to 0.4 mass %, Mn (manganese): 0.6 mass % to 1.5 mass %, Ni (nickel): more than 0 mass % up to 2.0 mass %, Cr (chromium): 0.8 mass % to 2.5 mass %, Mo (molybdenum): 0.10 mass % to 0.7 mass %, V (vanadium): 0.035 mass % to 0.20 mass %, Al (aluminum): 0.015 mass % to 0.050 mass %, N (nitrogen): 30 ppm to 100 ppm, and O (oxygen): more than 0 ppm up to 30 ppm, the balance being Fe (iron) and inevitable impurities, wherein the metal structure is mainly bainite, martensite or a mixed structure of bainite and martensite, and among cubic B1-type precipitates, the number of coherent precipitates having a diameter equal to or smaller than 30 nm is equal to or smaller than $50/\mu m^2$.

BRIEF DESCRIPTION OF DRAWINGS

FIG. 1 is a graph illustrating the relationship between tensile strength and tool wear amount in examples.

DESCRIPTION OF EMBODIMENTS

The inventors conducted extensive research on most appropriate structure forms with a view to achieving conflicting characteristics, namely higher strength and enhanced machinability and polishability, in forging steel. The inventors found as a result that reducing the number of coherent precipitates having a diameter equal to or smaller than 30 nm, from among cubic B1-type precipitates, was important in order to achieve both higher strength and enhanced machinability and polishability, and found the below-described high-strength steel for steel forgings that allows combining higher strength with enhanced machinability and polishability.

The high-strength steel for steel forgings in one aspect of the present invention has a composition that includes, as basic components, C (carbon): 0.35 mass % to 0.47 mass %, Si (silicon): 0 mass % to 0.4 mass %, Mn (manganese): 0.6 mass % to 1.5 mass %, Ni (nickel): more than 0 mass % up to 2.0 mass %, Cr (chromium): 0.8 mass % to 2.5 mass %, Mo (molybdenum): 0.10 mass % to 0.7 mass %, V (vanadium): 0.035 mass % to 0.20 mass %, Al (aluminum): 0.015 mass % to 0.050 mass %, N (nitrogen): 30 ppm to 100 ppm, and O (oxygen): more than 0 ppm up to 30 ppm, the balance being Fe (iron) and inevitable impurities. The main metal structure of the high-strength steel for steel forgings is bainite, martensite or a mixed structure of bainite and martensite, and the number of coherent precipitates having a diameter equal to or smaller than 30 nm, from among cubic B1-type precipitates, is equal to or smaller than $50/\mu m^2$.

The high-strength steel for steel forgings of the present invention and the steel forging of the present invention exhibit high strength and boast excellent machinability and polishability, and hence can be suitably used, for instance, in transmission members for diesel engines that are utilized in vessels or generators.

Embodiments of the high-strength steel for steel forgings and of the steel forging according to the present invention will be explained next. In the embodiments, the term "coherent precipitates" denotes precipitates the atomic arrangement whereof exhibits continuity with that of the matrix. The term "diameter of coherent precipitates" denotes a given-direction tangent diameter (Feret diameter) in a structure photograph magnified through transmission electron microscopy (TEM). Further, the expression "main" metal structure signifies that the metal structure that takes up 95 area % or more of the total structure.

<Metal Structure>

The main metal structure of the high-strength steel for steel forgings of the present embodiment is bainite, martensite or a mixed structure of bainite and martensite. The lower limit of the area fraction of the main metal structure is 95%, preferably 98 area %, and more preferably 100 area %. The high-strength steel for steel forgings exhibits high strength by virtue of the fact that the metal structure is prescribed to be mainly bainite, martensite or a mixed structure of bainite and martensite. As a method for measuring the area fraction of bainite, martensite or a mixed structure of bainite and martensite, a method can be resorted to that involves photographing, using an optical microscope, cross-sections of the high-strength steel for steel forgings having undergone nital etching, visually observing the obtained micrographs, for division into metal structures of bainite, martensite, a mixed structure of bainite and martensite and other metal structures, and calculating then the surface area ratios of the foregoing.

In the high-strength steel for steel forgings of the present embodiment, the upper limit of the number of coherent precipitates having a diameter equal to or smaller than 30 nm and present among cubic B1-type precipitates is 50/$\mu m^2$, preferably 40/$\mu m^2$, and more preferably 30/$\mu m^2$. The metal structure of the high-strength steel for steel forgings of the present embodiment is mainly bainite, martensite or a mixed structure of the foregoing, wherein machinability is improved by setting the number of coherent precipitates in the metal structure to be equal to or smaller than the above upper limit. The underlying mechanism is unclear, but it is deemed that machinability and polishability can be improved, and the cutting time and polishing time shortened, through a reduction in the particles that offer resistance during cutting. Therefore, sufficient machinability and polishability may in some instances fail to be obtained when the number of coherent precipitates exceeds the above upper limit.

The above coherent precipitates can be identified in accordance with a method such as the one exemplified below. A sample is cut to a disc-like shape having a diameter of 3 mm and a thickness of 0.5 mm. The sample is polished down to 30 μm using emery paper, followed by twin-jet thinning, to prepare an electron microscope sample out of the sample. The electron microscope sample is observed through excitation of the g1* vector using a transmission electron microscope (TEM) at an acceleration voltage of 200 kV, whereupon coherent precipitates are viewed with paired-semicircle contrast (see for instance "Crystal Electron Microscopy for Material Researchers" by Uchida Rokakuho Publishing Co., Ltd. (pages 149-151)). For instance, there is captured a predetermined area centered on a point at which precipitates are observed most clearly through g1* vector excitation, within a structure photograph observed at 5000 magnifications, to identify thereby coherent precipitates in the predetermined area, and there is counted the number of precipitates observed to have a diameter equal to or smaller than 30 nm, from among the identified coherent precipitates. A given-direction tangent diameter (Feret diameter) in the structure photograph is observed as the diameter of the coherent precipitates.

<Composition>

The high-strength steel for steel forgings of the present embodiment has a composition that includes, as basic components, C: 0.35 mass % to 0.47 mass %; Si: 0 mass % to 0.4 mass %; Mn: 0.6 mass % to 1.5 mass %; Ni: more than 0 mass % up to 2.0 mass %; Cr: 0.8 mass % to 2.5 mass %; Mo: 0.10 mass % to 0.7 mass %; V: 0.035 mass % to 0.20 mass %; Al: 0.015 mass % to 0.050 mass %; N: 30 ppm to 100 ppm; and O: more than 0 ppm up to 30 ppm, the balance being Fe and inevitable impurities.

The lower limit of the C content in the high-strength steel for steel forgings of the present embodiment is 0.35 mass %, preferably 0.37 mass %. The upper limit of the C content is 0.47 mass %, preferably 0.40 mass %. Sufficient hardenability and strength may fail to be secured when the C content is lower than the above lower limit. When the C content exceeds the above upper limit, by contrast, an extreme drop in toughness may occur, and inverse V segregation in large ingots may be promoted, with a decrease in both toughness and machinability. Both hardenability and strength in the high-strength steel for steel forgings can be properly secured by prescribing the C content to lie within the above ranges.

The lower limit of the Si content in the high-strength steel for steel forgings of the present embodiment is 0 mass %, i.e. Si need not be present. The upper limit of the Si content is 0.4 mass %, preferably 0.3 mass %, and more preferably 0.2 mass %. When the Si content exceeds the above upper limit, segregation is promoted, and machinability may decrease. The machinability of the high-strength steel for steel forgings can be properly secured by prescribing the Si content to lie within the above ranges.

The lower limit of the Mn content in the high-strength steel for steel forgings of the present embodiment is 0.6 mass %, preferably 0.8 mass %. The upper limit of the Mn content is 1.5 mass %, preferably 1.0 mass %. When the Mn content is lower than the above lower limit, sufficient strength and hardenability may fail to be secured, and variability in grain size may fail to be sufficiently reduced. When on the other hand the Mn content exceeds the above upper limit, inverse V segregation is promoted, and machinability may decrease. The hardenability and strength of the high-strength steel for steel forgings can be properly secured, and variability in grain size sufficiently reduced, by prescribing the Mn content of the high-strength steel for steel forgings to lie within the above ranges.

The Ni content of the high-strength steel for steel forgings of the present embodiment is more than 0 mass %. The upper limit of the Ni content is 2.0 mass %, preferably 1.6 mass %, and more preferably 1.2 mass %. Sufficient strength and toughness may fail to be secured when the Ni content is lower than the above lower limit. On the other hand, sufficient machinability may fail to be secured when the Ni content exceeds the above upper limit. The strength, toughness and machinability of the high-strength steel for steel forgings can be properly secured by prescribing the Ni content to lie within the above ranges.

The lower limit of the Cr content in the high-strength steel for steel forgings of the present embodiment is 0.8 mass %, preferably 1.0 mass %. The upper limit of the Cr content is 2.5 mass %, preferably 2.0 mass %, and more preferably 1.6 mass %. Sufficient hardenability and toughness may fail to be secured when the Cr content is lower than the above lower limit. When on the other hand the Cr content exceeds the above upper limit, inverse V segregation is promoted, and machinability may decrease. The hardenability and the toughness of the high-strength steel for steel forgings can be secured properly by prescribing the Cr content of the high-strength steel for steel forgings of the present embodiment to lie within the above ranges.

The lower limit of the Mo content in the high-strength steel for steel forgings of the present embodiment is 0.10 mass %, preferably 0.2 mass %. The upper limit of the Mo content is 0.7 mass %, preferably 0.5 mass %. When the Mo content is lower than above lower limit, inverse V segregation is promoted, and machinability may decrease. When on the other hand the Mo content exceeds the above upper limit, micro-segregation (normal segregation) in the steel ingot is promoted, and toughness and machinability may decrease, or gravity segregation may occur more readily. The hardenability, strength and toughness of the high-strength steel for steel forgings can be secured properly by prescribing the Mo content to lie within the above ranges.

The lower limit of the V content in the high-strength steel for steel forgings of the present embodiment is 0.035 mass %, preferably 0.05 mass %. The upper limit of the V content is 0.20 mass %, preferably 0.15 mass %, and more preferably 0.10 mass %. When the V content is lower than the above lower limit, sufficient strength and hardenability may fail to be secured. When on the other hand the V content exceeds the above upper limit, micro-segregation (normal segregation) occurs readily, since the equilibrium distribution coefficient of V is low, and toughness and machinability may decrease. Both hardenability and strength of the high-strength steel for steel forgings can be secured by prescribing the V content to lie within the above ranges.

The lower limit of the Al content in the high-strength steel for steel forgings of the present embodiment is 0.015 mass %, preferably 0.019 mass %. The upper limit of the Al content is 0.050 mass %, preferably 0.030 mass %. The oxygen amount may fail to be sufficiently reduced when the Al content is lower than the above lower limit. When on the other hand the Al content exceeds the above upper limit, oxide coarsening is promoted, and toughness and machinability may decrease. A deoxygenation effect can be properly elicited, and toughness and machinability properly secured, by prescribing the Al content to lie within the above ranges.

The lower limit of the N content of the high-strength steel for steel forgings of the present embodiment is 30 ppm, preferably 50 ppm. The upper limit of the N content is 100 ppm, preferably 80 ppm and more preferably 60 ppm. The required toughness as steel that is used, for instance, in transmission members for diesel engines utilized in vessels or generators may fail to be secured when the N content is lower than the above lower limit. On the other hand, sufficient toughness and machinability may fail to be secured when the N content exceeds the above upper limit. By prescribing the N content to lie within the above ranges, it becomes possible to properly secure the toughness and machinability of the high-strength steel for steel forgings, through refining of crystal grains elicited by the nitrides formed N.

The high-strength steel for steel forgings of the present embodiment contains O as an inevitable impurity. This O is present in the form of oxides in the forging steel. The upper limit of the O content is 30 ppm, preferably 15 ppm and more preferably 10 ppm. When the O content exceeds the above upper limit, machinability may decrease on account of generation of coarse oxides.

Besides the basic components described above, the high-strength steel for steel forgings of the present embodiment includes Fe as the balance, and inevitable impurities. Examples of permissible inevitable impurities that can be mixed into the steel include, for instance, elements such as P (phosphorus), S (sulfur), Sn (tin), As (arsenic), Pb (lead) and Ti (titanium) that can be mixed in depending on circumstances such as starting materials, other materials, production equipment and the like.

The upper limit of the content of P, as an inevitable impurity in the high-strength steel for steel forgings of the present embodiment, is preferably 0.1 mass %, more preferably 0.05 mass %, and yet more preferably 0.01 mass %. Intergranular fracture derived from grain boundary segregation may be promoted when the P content exceeds the above upper limit.

The upper limit of the content of S being one such inevitable impurity is preferably 0.02 mass %, more preferably 0.01 mass %, and yet more preferably 0.005 mass %. Degradation of strength through an increase in sulfide inclusions may occur when the S content exceeds the above upper limit.

Herein it may be effective to further incorporate other elements actively into the high-strength steel for steel forgings of the present embodiment. The characteristics of the forged steel material are further improved depending on the type of the element (chemical component) that is incorporated.

For instance, Cu may be added, as another element, to the high-strength steel for steel forgings of the present embodiment. The lower limit of the Cu content in the high-strength steel for steel forgings in a case where Cu is added is preferably 0.1 mass %, more preferably 0.2 mass %. The upper limit of the Cu content is preferably 1.5 mass %, more preferably 1.2 mass %. When the Cu content is lower than the above lower limit, a hardenability enhancing effect may fail to be elicited. On the other hand, toughness and machinability may decrease when the Cu content exceeds the above upper limit. The hardenability enhancing effect is effectively elicited, and toughness and machinability are improved, by prescribing the Cu content of the high-strength steel for steel forgings to lie within the above ranges.

Further, Nb may be added, as another element, to the high-strength steel for steel forgings of the present embodiment. The upper limit of the Nb content in the high-strength steel for steel forgings in a case where Nb is added is preferably 0.5 mass %, more preferably 0.3 mass %. Adding Nb improves hardenability, but toughness and machinability may decrease when the Nb content exceeds the above upper limit.

Further, B may be added, as another element, to the high-strength steel for steel forgings of the present embodiment. The upper limit of the B content in the high-strength steel for steel forgings in a case where B is added is preferably 30 ppm, more preferably 20 ppm. Adding Nb improves hardenability, but toughness and machinability may decrease when the B content exceeds the above upper limit.

<Alloy Element Concentration in Cementite>

The metal structure of the high-strength steel for steel forgings of the present embodiment is mainly bainite, martensite or a mixed structure of bainite and martensite. Preferably, the cementite includes Cr or Mn at a predetermined concentration. The lower limit of the Cr concentration in the cementite is preferably 2.7 mass %, more preferably 3.0 mass %. The upper limit of the Cr concentration in the cementite is preferably 4.0 mass %, more preferably 3.5 mass %. The lower limit of the Mn concentration in the cementite is preferably 1.2 mass %, more preferably 1.3 mass %. The upper limit of the Mn concentration in the cementite is preferably 2.0 mass %, more preferably 1.8 mass %. Machinability may fail to be sufficiently improved when the Cr concentration in the cementite is lower than the above lower limits and the Mn concentration is likewise lower than the above lower limits. On the other hand, machinability may decrease, on account of promoted inverse V segregation, when the Cr concentration in the cementite exceeds the above upper limits or the Mn concentration exceeds the above upper limits. It is conjectured that by prescribing the Cr concentration or Mn concentration in the cementite to lie within the above ranges, a soft region of low Mn concentration becomes manifest around cementite, which is deemed to be one source factor of fatigue crack initiation; this region has the function of relieving stress during cutting, and is found to afford significantly improved machinability of the steel material as a whole.

<Mechanical Properties>

Preferably, the lower limit of tensile strength (TS) of the high-strength steel for steel forgings in the present embodiment is 850 MPa. The strength required by transmission members for diesel engines that are used in vessels or generators can be satisfied when the tensile strength of the high-strength steel for steel forgings is equal to or higher than the above lower limit. Tensile strength can be measured, for instance, on the basis of a tensile test according to JIS-Z2241 (2011).

Preferably, the lower limit of the absorbed energy vE (absorbed energy at room temperature) of the high-strength steel for steel forgings of the present embodiment is 45 J. The strength required by transmission members for diesel engines that are used in vessels or generators can be satisfied when the absorbed energy of the high-strength steel for steel forgings is equal to or higher than the above lower limit. The absorbed energy can be measured, for instance, on the basis of a Charpy impact test according to JIS-Z2242 (2005).

<Method for Producing a High-Strength Steel for Steel Forgings and a Steel Forging>

The high-strength steel for steel forgings of the present embodiment is produced, for instance, as a result of a melting step, casting step, heating step, forging step, quenching pretreatment step and thermal treatment step described below. The above steel forging is produced by working the high-strength steel for steel forgings in a machining step.

(Melting Step)

In the melting step, firstly the steel having been adjusted to the above-described predetermined composition is melted using a high-frequency melting furnace, an electric furnace, a converter or the like. The melted steel after component adjustment is subsequently subjected to a vacuum treatment, to remove therefrom gas components such as O (oxygen) and H (hydrogen) as well as impurity elements.

(Casting Step)

In the casting step, mainly ingots (steel ingots) are cast in the case of large-size forging steel. In the case of comparatively small steel forgings, a continuous method can be resorted to.

(Heating Step)

In the heating step, the steel ingot is heated at a predetermined temperature for a predetermined time. At low temperatures, the deformation resistance of the material increases, and hence the heating temperature is set to 1150° C. or higher in order to perform working within a good range of material deformability. A predetermined heating time is required in order to render homogeneous the temperature at the surface of the steel ingot and in the interior of the latter. The heating time is set herein to 3 hours or longer. It is deemed that ordinarily the heating time is proportional to the square of the diameter of the workpiece, and thus the larger the material, the longer is the heating holding time.

(Forging Step)

In the forging step there is forged the steel ingot having been heated to a temperature of 1150° C. or higher in the heating step. Preferably, the forging ratio is set to 3S or higher in order to pressure-fuse casting defects such as shrinkage porosity and microporosity.

(Quenching Pretreatment Step)

In the quenching pretreatment step, the forged steel material is left to cool in the atmosphere, and thereafter the steel material is heated up to a predetermined temperature (for instance, in the range 550° C. to 650° C.) that is held for a predetermined time (for instance, 10 hours or longer), followed by cooling. Coherent precipitates in the steel material can be reduced by performing a quenching pretreatment step before the quenching process.

(Thermal Treatment Step)

The thermal treatment step involves performing tempering after the quenching process. The quenching process involves raising the temperature of the steel material, having been cooled in the quenching pretreatment step, up to a predetermined temperature (for instance, in the range 800° C. to 950° C.), and holding that temperature for a predetermined time (for instance, 1 hour or longer), followed by cooling down to a predetermined temperature (for instance, in the range 450° C. to 530° C.). Thereafter, a tempering process is carried out to obtain thereby the high-strength steel for steel forgings of the present embodiment. Tempering of the steel material involves herein gradual heating at a rate of temperature rise ranging from 30 to 70° C./hr up to a predetermined temperature, and holding of the temperature for a given time (for instance, 5 to 20 hours), followed by cooling. Tempering is performed at a temperature of 550° C. or higher in order to adjust the balance of strength, ductility and toughness, and eliminating internal stress (residual stress) derived from phase transformations. Tempering is however performed at a temperature of 650° C. or lower, since at high temperatures the steel material softens, for instance, on account of carbide coarsening, dislocation structure recovery, and sufficient strength cannot be secured.

(Machining Step)

A steel forging can be then obtained by subjecting the surface layer of the high-strength steel for steel forgings after the thermal treatment step to finishing machining such as cutting or grinding.

The present description discloses the various technology implementations described above, in terms of making it possible to solve the above-described problems by resorting to the embodiments described below. The present invention is not limited to the solution described below, and needless to say the entire disclosure of the specification can be taken into consideration.

One aspect of the present invention is a high-strength steel for steel forgings having a composition that includes, as basic components, C (carbon): 0.35 mass % to 0.47 mass %, Si (silicon): 0 mass % to 0.4 mass %, Mn (manganese): 0.6 mass % to 1.5 mass %, Ni (nickel): more than 0 mass % up to 2.0 mass %, Cr (chromium): 0.8 mass % to 2.5 mass %, Mo (molybdenum): 0.10 mass % to 0.7 mass %, V (vanadium): 0.035 mass % to 0.20 mass %, Al (aluminum): 0.015 mass % to 0.050 mass %, N (nitrogen): 30 ppm to 100 ppm, and O (oxygen): more than 0 ppm up to 30 ppm, the balance being Fe (iron) and inevitable impurities, wherein the metal structure is mainly bainite, martensite or a mixed structure of bainite and martensite, and among cubic B1-type precipitates, the number of coherent precipitates having a diameter equal to or smaller than 30 nm is equal to or smaller than $50/\mu m^2$.

By virtue of setting the contents of the components of the steel material in the high-strength steel for steel forgings to lie within the above ranges, and prescribing the metal structure of the high-strength steel for steel forgings to be mainly bainite, martensite or a mixed structure of bainite and martensite, the steel exhibits sufficient strength as a transmission member or the like for diesel engines that is used, for instance, in vessels or generators. It is found that particles that offer resistance during cutting and polishing are reduced by virtue of the fact that the number of coherent precipitates in the metal structure of the high-strength steel for steel forgings is no greater than the above upper limit. As a result, high strength is secured in the steel, while the latter boasts excellent machinability and polishability.

Preferably, the high-strength steel for steel forgings further includes, as other components, Cu (copper): more than 0 mass % up to 1.5 mass %, Nb (niobium): more than 0 mass % up to 0.5 mass %, or B (boron): more than 0 ppm up to 30 ppm. Hardenability can be enhanced through incorporation of such elements.

Preferably, the Cr (chromium) concentration is 2.7 mass % or higher or the concentration of Mn (manganese) concentration is 1.2 mass % or higher in cementite in the high-strength steel for steel forgings. By prescribing the Cr concentration or Mn concentration in cementite to lie within the above ranges, an appropriately soft region becomes manifest around cementite, which is deemed to be one source factor of fatigue crack initiation; it is found that this region tends to relieve cracking stress, and thus fatigue characteristic is significantly improved. It becomes possible as a result to further enhance machinability and polishability, as described above.

A further aspect of the present invention is a steel forging that is obtained through cutting or grinding of the high-strength steel for steel forgings. The steel forging is made up of the above high-strength steel for steel forgings, and hence exhibits high strength and boasts excellent machinability and polishability as described above.

EXAMPLES

The present invention will be explained next in further detail on the basis of examples. The present invention is however not limited to or by the examples below.

[Production of Test Samples]

Example 1

A steel starting material having the composition given in the columns of Example 1 in Table 1 was melted in a high-frequency furnace, and was cast to yield a steel ingot (50 kg) having a diameter in the range 132 mm to 158 mm and a length of 323 mm. The feeder portion of the obtained steel ingot was cut off, and the ingot was heated at 1230° C. for 5 to 10 hours. The steel ingot was thereafter forged through compression down to a height ratio of 1/2 and through 90°-rotation of the center line of the steel ingot using a free forging press, with drawing up to 90 mm×90 mm×450 mm, followed by cooling in the atmosphere. Before carrying out a quenching process, the resulting material having been left to cool at room temperature was heated (i.e. heated at a temperature of 500° C. or higher at 50° C./hr or less) and the temperature was held at 650° C. for 10 hours, followed by furnace cooling (quenching pretreatment). Thereafter a quenching process was carried out using a compact simulate furnace. In the quenching process, the temperature of the material was raised up to 870° C. at a rate of temperature rise of 50° C./hr, the temperature was held for 3 hours, and thereafter, the material was cooled at an average cooling rate of 50° C./min, in a temperature region from 870° C. to 500° C. As a tempering process, the material was held thereafter at 600° C. for 10 hours, and was subsequently furnace-cooled. A test sample of the high-strength steel for steel forgings of Example 1 was thus produced. The dashes "-" in Table 1 denote values at or below the measurement limit.

Examples 2 to 12 and Comparative Examples 1 to 17

Test samples of the high-strength steel for steel forgings of Examples 2 to 12 and Comparative examples 1 to 17 were produced in accordance with the same procedure as that of Example 1, but with the compositions given in the columns for Examples 2 to 12 and Comparative examples 1 to 17 in Table 1, and by setting the holding temperature in the quenching pretreatment and the holding temperature in the tempering process to the temperatures given in Table 1. The holding time in the quenching pretreatment was set to 10 hours, as in Example 1.

The contents of C, Si, Mn, Ni, Cr, Mo, V, Al, N and O in the test samples of Examples 1 to 12 lie in the ranges of the present invention. The contents of at least some from among C, Si, Mn, Ni, Cr, Mo, V, Al, N and O in the test samples of Comparative examples 1 to 17 lie outside the ranges of the present invention.

Comparative Examples 18 to 20

The steel starting materials of the high-strength steel for steel forgings in Comparative examples 18 to 20, were set to have identical compositions, as given in Table 1. The contents of C, Si, Mn, Ni, Cr, Mo, V, Al, N and O lie in the range of the present invention. In the high-strength steel for steel forgings in Comparative examples 18 to 20, the holding time in the quenching pretreatment was set to 8 hours, shorter than the holding time in Example 1, and the holding temperature in the quenching pretreatment was set to 550° C., 600° C. and 650° C., respectively.

Comparative Examples 21 to 22

Test samples of the high-strength steel for steel forgings in Comparative examples 21 and 22 were produced in accordance with a conventional production method in which the above quenching pretreatment was not carried out. The composition of the steel starting material used in the high-strength steel for steel forgings of Comparative examples 21 and 22 was set to the composition used in Japanese Patent No. 3896365 and Japanese Patent No. 4332070. The contents of C, Si, Mn, Ni, Cr, Mo, V, Al, N and O in these compositions lie in the range of the present invention.

[Measurement of Number Density of Coherent Precipitates]

Each test sample was cut out to a disc-like shape having a diameter of 3 mm and a thickness of 0.5 mm. The sample was polished down to 30 μm using emery paper, followed by twin-jet thinning, to prepare an electron microscope sample out of the sample. The electron microscope sample was checked by transmission electron microscopy (TEM) at an acceleration voltage of 200 kV, to identify coherent precipitates as a result. Specifically, there was imaged a 5 cm×5 cm square centered on the point at which precipitates were observed most clearly upon g1* vector excitation, within a structure micrograph obtained by TEM at 5000 magnifications, the number of coherent precipitates (coherent precipitates having a diameter equal to or smaller than 30 nm) present within that square was counted, and the average value of the count tallies for 10 fields was taken as the number density of coherent precipitates.

[Concentration Analysis of Alloy Elements in Cementite]

A concentration analysis of the alloy elements in cementite was carried out by quantitative analysis through scanning electron microscopy (SEM) with EDX. Herein, EDX involves detecting characteristic X-rays generated through electron beam irradiation, and spectroscopically resolving the X-rays according to energy, to perform elemental analysis and composition analysis.

[Measurement of Mechanical Properties]

After the thermal treatment, the test sample was worked in such a manner that the longitudinal direction of the test piece was parallel to the forging direction, and was subjected to a tensile test. The test piece shape was set to ϕ6×G.L. 30 mm and/or #14 test piece according to JIS-Z2241 (2011), and the tensile strength (TS) was measured. In the present test, test pieces having a tensile strength of 850 MPa or higher were determined as acceptable.

Toughness was evaluated by measuring the absorbed energy (vE) (absorbed energy at room temperature) of the test sample on the basis of a Charpy impact test. The Charpy impact test was performed according to JIS-Z2242 (2005), with a 2 mm V-notch of JIS-Z2242 (2005) as the test piece shape. Test pieces having an absorbed energy of 45 J or higher were deemed to be acceptable in the present test.

To evaluate machinability, an end mill cutting test was carried out, and there was measured the tool wear amount upon intermittent cutting of the steel material. Each end mill cutting test piece used in the end mill cutting test was obtained by removing scale from the test sample and grinding then the surface by about 2 mm. Specifically, an end mill tool was attached to a machining center spindle, each 25 mm×80 mm×80 mm test piece produced as described above was fixed using a vise, and the test piece was cut down in a dry cutting atmosphere. More specifically, the test piece was cut over a cutting length of 29 m, with an axial depth of cut of 1.0 mm, a radial depth of cut of 1.0 mm, a feed amount of 0.117 mm/rev and a feed rate of 556.9 mm/min, using a TiAlN-coated high-speed end mill ("K-2SL", by Mitsubishi Materials Corporation) having an outer diameter of ϕ10.0 mm. After 200 intermittent cuts, the high-speed end mill surface was observed using an optical microscope at 100 magnifications. A flank wear amount (tool wear amount) Vb was measured and an average value thereof was worked out. In the present test, samples for which the flank wear amount Vb was 70 μm or smaller were determined to be acceptable test pieces having superior machinability upon intermittent cutting.

In the present test, samples for which tensile strength, absorbed energy and machinability were determined as acceptable were assigned an overall rating "A", and other samples were assigned an overall rating "B". The measurement results are given in Table 1.

TABLE 1

| | Composition content (mass %) | | | | | | | | | | | | | | | Quenching pretreatment | | Tempering | Coherent precipitate | Concentration in cementite (mass %) | | TS | vE | Vb | Overall |
|---|---|---|---|---|---|---|---|---|---|---|---|---|---|---|---|---|---|---|---|---|---|---|---|---|---|
| | C | Si | Mn | P | S | Cu | Ni | Cr | Mo | V | Al | N (ppm) | O (ppm) | Nb | B (ppm) | (° C.) | (hr) | (° C.) | (number) | Cr | Mn | (MPa) | (J) | (μm) | rating |
| Ex. 1 | 0.37 | 0.30 | 0.91 | 0.009 | 0.002 | 0.04 | 0.4 | 2.04 | 0.29 | 0.085 | 0.019 | 54 | 11 | — | — | 650 | 10 | 600 | 2 | 2.6 | 1.0 | 1000 | 65 | 37 | A |
| Ex. 2 | 0.38 | 0 | 0.88 | 0.010 | 0.002 | — | 0.4 | 2.05 | 0.30 | 0.086 | 0.019 | 58 | 12 | — | — | 650 | 10 | 615 | 3 | 2.6 | 1.0 | 974 | 68 | 36 | A |
| Ex. 3 | 0.38 | 0.30 | 1.10 | 0.010 | 0.002 | 0.04 | 0.4 | 2.05 | 0.30 | 0.086 | 0.019 | 58 | 12 | — | — | 600 | 10 | 630 | 5 | 2.6 | 1.3 | 900 | 76 | 27 | A |
| Ex. 4 | 0.38 | 0.30 | 0.93 | 0.010 | 0.002 | — | 0.4 | 2.12 | 0.30 | 0.086 | 0.019 | 58 | 12 | — | — | 600 | 10 | 600 | 4 | 2.7 | 1.1 | 1015 | 64 | 34 | A |
| Ex. 5 | 0.38 | 0.30 | 1.18 | 0.010 | 0.002 | 0.04 | 0.4 | 2.42 | 0.30 | 0.086 | 0.019 | 58 | 12 | — | — | 550 | 10 | 630 | 7 | 3.0 | 1.4 | 914 | 74 | 30 | A |
| Ex. 6 | 0.37 | 0.30 | 1.15 | 0.009 | 0.002 | — | 0.4 | 2.15 | 0.29 | 0.085 | 0.019 | 54 | 11 | — | — | 650 | 10 | 600 | 2 | 2.7 | 1.3 | 1013 | 64 | 27 | A |
| Ex. 7 | 0.38 | 0.30 | 0.93 | 0.010 | 0.002 | 1.00 | 0.4 | 2.12 | 0.30 | 0.086 | 0.019 | 58 | 12 | — | — | 600 | 10 | 600 | 4 | 2.7 | 1.1 | 1105 | 56 | 41 | A |
| Ex. 8 | 0.38 | 0.30 | 0.93 | 0.010 | 0.002 | — | 0.4 | 2.12 | 0.30 | 0.086 | 0.019 | 58 | 12 | 0.10 | — | 600 | 10 | 600 | 4 | 2.7 | 1.1 | 1055 | 60 | 37 | A |
| Ex. 9 | 0.38 | 0.30 | 1.18 | 0.010 | 0.002 | 0.04 | 0.4 | 2.42 | 0.30 | 0.086 | 0.019 | 58 | 12 | — | 20 | 550 | 10 | 630 | 7 | 3.0 | 1.4 | 954 | 70 | 27 | A |
| Ex. 10 | 0.35 | 0 | 0.90 | 0.004 | 0.003 | — | 1.6 | 1.60 | 0.50 | 0.150 | 0.025 | 60 | 10 | — | — | 650 | 10 | 580 | 6 | 2.0 | 1.0 | 1200 | 49 | 54 | A |
| Ex. 11 | 0.35 | 0 | 1.20 | 0.004 | 0.002 | — | 1.6 | 1.60 | 0.50 | 0.150 | 0.025 | 60 | 10 | — | — | 650 | 10 | 580 | 7 | 2.0 | 1.4 | 1212 | 48 | 50 | A |
| Ex. 12 | 0.35 | 0 | 0.90 | 0.004 | 0.003 | — | 2.0 | 1.60 | 0.50 | 0.150 | 0.025 | 60 | 10 | — | — | 650 | 10 | 580 | 7 | 2.0 | 1.0 | 1221 | 48 | 56 | A |
| Comp. ex. 1 | 0.34 | 0.30 | 0.91 | 0.010 | 0.002 | 0.04 | 0.4 | 1.95 | 0.30 | 0.086 | 0.019 | 58 | 12 | — | — | 550 | 10 | 615 | 6 | 2.4 | 1.0 | 801 | 89 | 26 | B |
| Comp. ex. 2 | 0.49 | 0.30 | 0.88 | 0.010 | 0.002 | 0.04 | 0.4 | 1.95 | 0.30 | 0.086 | 0.019 | 58 | 12 | — | — | 550 | 10 | 615 | 25 | 2.4 | 1.0 | 1061 | 25 | 99 | B |
| Comp. ex. 3 | 0.38 | 0.42 | 0.87 | 0.010 | 0.002 | 0.04 | 0.4 | 1.95 | 0.30 | 0.086 | 0.019 | 58 | 12 | — | — | 550 | 10 | 615 | 6 | 2.4 | 1.0 | 939 | 38 | 76 | B |
| Comp. ex. 4 | 0.38 | 0.30 | 0.50 | 0.010 | 0.002 | 0.04 | 0.4 | 1.95 | 0.30 | 0.086 | 0.019 | 58 | 12 | — | — | 550 | 10 | 615 | 7 | 2.4 | 0.6 | 827 | 85 | 28 | B |
| Comp. ex. 5 | 0.38 | 0.30 | 1.55 | 0.010 | 0.002 | 0.04 | 0.4 | 1.95 | 0.30 | 0.086 | 0.019 | 58 | 12 | — | — | 550 | 10 | 615 | 8 | 2.4 | 1.8 | 973 | 35 | 80 | B |
| Comp. ex. 6 | 0.38 | 0.30 | 0.91 | 0.010 | 0.002 | 0.04 | 2.1 | 1.95 | 0.30 | 0.086 | 0.019 | 58 | 12 | — | — | 550 | 10 | 615 | 7 | 2.4 | 1.0 | 1035 | 29 | 83 | B |
| Comp. ex. 7 | 0.38 | 0.30 | 0.88 | 0.010 | 0.002 | 0.04 | 0.4 | 0.7 | 0.30 | 0.086 | 0.019 | 58 | 12 | — | — | 550 | 10 | 615 | 7 | 0.9 | 1.0 | 808 | 88 | 27 | B |
| Comp. ex. 8 | 0.38 | 0.30 | 0.91 | 0.010 | 0.002 | 0.04 | 0.4 | 2.6 | 0.30 | 0.086 | 0.019 | 58 | 12 | — | — | 550 | 10 | 615 | 8 | 3.3 | 1.0 | 970 | 34 | 79 | B |
| Comp. ex. 9 | 0.38 | 0.30 | 0.87 | 0.010 | 0.002 | 0.04 | 0.4 | 1.95 | 0.07 | 0.086 | 0.019 | 58 | 12 | — | — | 550 | 10 | 615 | 6 | 2.4 | 1.0 | 822 | 86 | 27 | B |
| Comp. ex. 10 | 0.38 | 0.30 | 0.91 | 0.010 | 0.002 | 0.04 | 0.4 | 1.95 | 0.75 | 0.086 | 0.019 | 58 | 12 | — | — | 550 | 10 | 615 | 8 | 2.4 | 1.0 | 986 | 36 | 80 | B |
| Comp. ex. 11 | 0.38 | 0.30 | 0.88 | 0.010 | 0.002 | 0.04 | 0.4 | 1.95 | 0.30 | 0.032 | 0.019 | 58 | 12 | — | — | 550 | 10 | 615 | 4 | 2.4 | 1.0 | 806 | 88 | 25 | B |
| Comp. ex. 12 | 0.38 | 0.30 | 0.91 | 0.010 | 0.002 | 0.04 | 0.4 | 1.95 | 0.30 | 0.210 | 0.019 | 58 | 12 | — | — | 550 | 10 | 615 | 15 | 2.4 | 1.0 | 1053 | 28 | 91 | B |
| Comp. ex. 13 | 0.38 | 0.30 | 0.87 | 0.010 | 0.002 | 0.04 | 0.4 | 1.95 | 0.30 | 0.086 | 0.014 | 58 | 12 | — | — | 550 | 10 | 615 | 7 | 2.4 | 1.0 | 948 | 37 | 77 | B |
| Comp. ex. 14 | 0.38 | 0.30 | 0.91 | 0.010 | 0.002 | 0.04 | 0.4 | 1.95 | 0.30 | 0.086 | 0.053 | 58 | 12 | — | — | 550 | 10 | 615 | 6 | 2.4 | 1.0 | 949 | 36 | 76 | B |
| Comp. ex. 15 | 0.38 | 0.30 | 0.88 | 0.010 | 0.002 | 0.04 | 0.4 | 1.95 | 0.30 | 0.086 | 0.019 | 28 | 12 | — | — | 550 | 10 | 615 | 7 | 2.4 | 1.0 | 948 | 37 | 86 | B |
| Comp. ex. 16 | 0.38 | 0.30 | 0.91 | 0.010 | 0.002 | 0.04 | 0.4 | 1.95 | 0.30 | 0.086 | 0.019 | 102 | 12 | — | — | 550 | 10 | 615 | 12 | 2.4 | 1.0 | 949 | 36 | 81 | B |

TABLE 1-continued

| | Composition content (mass %) | | | | | | | | | | | | | | | Quenching pretreatment | | Tempering | Coherent precipitate | Concentration in cementite (mass %) | | TS | vE | Vb | Overall |
|---|---|---|---|---|---|---|---|---|---|---|---|---|---|---|---|---|---|---|---|---|---|---|---|---|---|
| | C | Si | Mn | P | S | Cu | Ni | Cr | Mo | V | Al | N (ppm) | O (ppm) | Nb | B (ppm) | (° C.) | (hr) | (° C.) | (number) | Cr | Mn | (MPa) | (J) | (μm) | rating |
| Comp. ex. 17 | 0.38 | 0.30 | 0.87 | 0.010 | 0.002 | 0.04 | 0.4 | 1.95 | 0.30 | 0.086 | 0.019 | 58 | 32 | — | — | 550 | 10 | 615 | 7 | 2.4 | 1.0 | 948 | 37 | 77 | B |
| Comp. ex. 18 | 0.38 | 0.30 | 0.91 | 0.010 | 0.002 | 0.04 | 0.4 | 1.95 | 0.30 | 0.086 | 0.019 | 58 | 12 | — | — | 550 | 8 | 615 | 63 | 2.4 | 1.0 | 949 | 70 | 82 | B |
| Comp. ex. 19 | 0.38 | 0.30 | 0.91 | 0.010 | 0.002 | 0.04 | 0.4 | 1.95 | 0.30 | 0.086 | 0.019 | 58 | 12 | — | — | 600 | 8 | 615 | 57 | 2.4 | 1.0 | 949 | 70 | 77 | B |
| Comp. ex. 20 | 0.38 | 0.30 | 0.91 | 0.010 | 0.002 | 0.04 | 0.4 | 1.95 | 0.30 | 0.086 | 0.019 | 58 | 12 | — | — | 650 | 8 | 615 | 52 | 2.4 | 1.0 | 949 | 70 | 73 | B |
| Comp. ex. 21 | 0.40 | 0.24 | 1.04 | — | 0.003 | — | 0.20 | 1.97 | 0.26 | 0.054 | 0.003 | 45 | — | — | — | — | — | 610 | 55 | 2.5 | 1.2 | 960 | 69 | 76 | B |
| Comp. ex. 22 | 0.34 | 0.22 | 0.98 | 0.007 | 0.003 | 0.04 | 1.58 | 1.59 | 0.49 | 0.16 | 0.020 | 60 | — | — | — | — | — | 610 | 75 | 2.0 | 1.1 | 1063 | 59 | 99 | B |

[Measurement Results]

The test samples of Examples 1 to 12 exhibited all high strength and excellent toughness and machinability, and were thus assigned an overall rating A.

By contrast, the test samples of Comparative examples 1 to 17 exhibited all tensile strength and toughness outside acceptable ranges, and were assigned an overall rating B. These test samples are produced using steel having a composition that does not satisfy the ranges of basic components of the present invention. It is found that the tensile strength of test samples (Comparative examples 1, 4, 7, 9 and 11) with compositions having elements (except Al and N) below the lower limits of content specified in the present invention is low, since the ranges of the basic components of the present invention define a composition for enhancing strength, except for Al and N. On the other hand, the tensile strength of test samples (Comparative examples 2, 3, 5, 6, 8, 10, 12, 14, 16 and 17) with compositions having elements (except Al and N) beyond the upper limits of content specified in the present invention is high, but toughness and machinability are low, since cutting resistance increases proportionally to strength. Herein, Al and N are elements that enhance toughness when present in appropriate content. Therefore, toughness and machinability is low in those test samples (Comparative examples 13 and 15) in which the respective content of these elements is below the lower limit or above the upper limit of content as specified in the present invention.

Tensile strength and toughness were excellent in the test samples of Comparative examples 18 to 22, but machinability was poor. This can be ascribed to the substantial amount of coherent precipitates having a diameter equal to or smaller than 30 nm, with a number density thereof in excess of 50/μm$^2$. The underlying mechanism for this is unclear, but it is deemed that machinability drops on account of an increase in the particles that offer resistance during cutting, when coherent precipitates are numerous. The results of Table 1 indicate that the number of coherent precipitates having a diameter equal to or smaller than 30 nm that precipitate herein can be controlled by modifying the holding time in the quenching pretreatment.

(Relationship Between Tensile Strength and Tool Wear Amount)

FIG. 1 illustrates a relationship between tensile strength and tool wear amount measured in the examples and comparative examples. FIG. 1 reveals that Examples 1 to 12 exhibit both high strength and excellent machinability. In Comparative examples 1 to 22, by contrast, tool wear amount exceeds 70 μm when tensile strength is 850 MPa or higher, while tensile strength is lower than 850 MPa when the tool wear amount is 70 m or smaller, and thus high strength and machinability were not achieved concurrently.

(Addition of Other Components)

The composition of Example 7 is the composition of Example 4 with Cu added thereto. The composition of Example 8 is the composition of Example 4 with Nb added thereto. The composition of Example 9 is the composition of Example 5 with B added thereto. A comparison of the measurement results for these examples reveals that strength can be significantly enhanced, while sufficiently securing toughness and machinability, by adding Cu, Nb or B.

(Element Concentration in Cementite)

The composition of Example 4 is identical to the composition of Example 2, but the Cr concentration in the cementite is 2.7 mass % or higher, i.e. higher than that of Example 2. A comparison of the measurement results of the foregoing reveals that Example 4 exhibits higher tensile strength than Example 2, without loss in machinability. The compositions of Example 10 to 12 are substantially identical; and the Mn concentration in the cementite, at 1.2 mass % or higher, is higher than that of Examples 10 and 12 only in Example 11. Example 11 exhibits a tensile strength similar to that in Examples 10 and 12, and better machinability than that in Examples 10 and 12.

The present application claims priority based on Japanese Patent Application No. 2013-262720, filed on Dec. 19, 2013, the entire contents whereof are incorporated herein by reference.

The present invention has been appropriately and sufficiently explained above by way of embodiments, with reference to accompanying drawings and the like, for the purpose of illustrating the invention. A person skilled in the art should recognize, however, that the embodiments described above can be easily modified and/or improved. Therefore, it is understood that any modified embodiments or improved embodiments that a person skilled in the art can arrive at are encompassed within the scope as claimed in the appended claims, so long as these modifications and improvements do not depart from the scope of the claims.

INDUSTRIAL APPLICABILITY

The present invention has wide industrial applicability in the technical field of marine steel forgings. In particular, the invention is useful as a material in intermediate shafts, propeller shafts, connecting rods, rudder stocks, rudder horns, crankshafts and the like that are used as transmission members in marine drive sources.

The invention claimed is:

1. A high-strength steel for steel forgings, having a composition that includes, as basic components:

C: 0.35 mass % to 0.47 mass %;

Si: 0 mass % to 0.4 mass %;

Mn: 0.6 mass % to 1.5 mass %:

Ni: more than 0 mass % up to 2.0 mass %;

Cr: 0.8 mass % to 2.5 mass %;

Mo: 0.10 mass % to 0.7 mass %;

V: 0.035 mass % to 0.20 mass %;

Al: 0.015 mass % to 0.050 mass %;

N: 30 ppm to 100 ppm;

O: more than 0 ppm up to 30 ppm,

Fe and inevitable impurities, wherein the steel has a metal structure comprising mainly bainite, martensite or a mixed structure of bainite and martensite, and among precipitates of cubic B1 structure, a number of coherent precipitates having a diameter equal to or smaller than 30 nm is equal to or smaller than 50/μm$^2$.

2. The steel according to claim 1, further comprising, as other components:

Cu: more than 0 mass % up to 1.5 mass %;

Nb: more than 0 mass % up to 0.5 mass; or

B: more than 0 ppm up to 30 ppm.

3. The steel according to claim 1, wherein the Cr concentration is 2.7 mass % or higher or the Mn concentration is 1.2 mass % or higher in cementite.

4. A steel forging, obtained through cutting or grinding the steel according to claim 1.

5. A steel forging, obtained through cutting or grinding the steel according to claim 2.

6. A steel forging, obtained through cutting or grinding the steel according to claim 3.

* * * * *